US010518948B2

(12) United States Patent
Defert

(10) Patent No.: US 10,518,948 B2
(45) Date of Patent: Dec. 31, 2019

(54) PERFORATING CAP, PARTICULARLY FOR A FLEXIBLE TUBE

(71) Applicant: ALBEA SERVICES, Gennevilliers (FR)

(72) Inventor: Sylvain Defert, Saint Ouen l'Aumone (FR)

(73) Assignee: ALBEA SERVICES, Gennevilliers (FR)

( * ) Notice: Subject to any disclaimer, the term of this patent is extended or adjusted under 35 U.S.C. 154(b) by 183 days.

(21) Appl. No.: 15/490,862

(22) Filed: Apr. 18, 2017

(65) Prior Publication Data

US 2017/0297783 A1 Oct. 19, 2017

(30) Foreign Application Priority Data

Apr. 19, 2016 (FR) ..... 16 53453
Jun. 23, 2016 (FR) ..... 16 55899
Mar. 7, 2017 (FR) ..... 17 51860

(51) Int. Cl.

| | |
|---|---|
| ***B65D 51/22*** | (2006.01) |
| ***B65D 35/44*** | (2006.01) |
| ***B65D 1/02*** | (2006.01) |
| ***B65D 41/02*** | (2006.01) |
| ***B65D 41/04*** | (2006.01) |
| ***B65D 41/06*** | (2006.01) |
| ***B65D 47/36*** | (2006.01) |

(52) U.S. Cl.

CPC ..... *B65D 51/225* (2013.01); *B65D 1/0246* (2013.01); *B65D 35/44* (2013.01); *B65D 41/02* (2013.01); *B65D 41/04* (2013.01); *B65D 41/06* (2013.01); *B65D 47/36* (2013.01); *B65D 51/222* (2013.01); *B65D 2251/009* (2013.01); *B65D 2251/0015* (2013.01); *B65D 2251/0028* (2013.01); *B65D 2251/0093* (2013.01)

(58) Field of Classification Search

CPC .... B65D 51/225; B65D 51/222; B65D 35/44; B65D 47/36; B65D 41/06; B65D 41/04; B65D 1/0246; B65D 41/02; B65D 2251/009; B65D 2251/0028; B65D 2251/0015; B65D 2251/0093

USPC ..... 220/278; 222/83

See application file for complete search history.

(56) References Cited

U.S. PATENT DOCUMENTS 2,771,218 A 11/1956 Henderson
4,307,821 A * 12/1981 McIntosh ..... B65D 41/3442 215/256
4,867,326 A 9/1989 O'Meara
(Continued)

FOREIGN PATENT DOCUMENTS

FR 2234206 1/1975
WO WO97/00816 1/1997

*Primary Examiner* — James N Smalley
(74) *Attorney, Agent, or Firm* — Steven M. Greenberg, Esq.; Shutts & Bowen LLP

(57) ABSTRACT

The present invention relates to an assembly for closing a tube. The assembly includes a tube head including a neck and a closure liner sealing the neck. The assembly also includes a cap that includes a punch adapted to cut the closure liner. The neck and the cap are configured to allow the cap to be fixedly held on the neck in a first position—the standby position—in which the punch is held at a distance from the closure liner, and in a second position—the position of use—in which the punch perforates the closure liner.

29 Claims, 6 Drawing Sheets

(56) References Cited

U.S. PATENT DOCUMENTS

| | | | | |
|---|---|---|---|---|
| 5,566,845 | A * | 10/1996 | Frank | B65D 25/44<br>215/208 |
| 5,947,318 | A * | 9/1999 | Palm | B65D 5/746<br>220/278 |
| 2008/0245380 | A1 | 10/2008 | Ecker William et al. | |
| 2017/0066568 | A1 * | 3/2017 | Stever | B65D 47/06 |

* cited by examiner

PERFORATING CAP, PARTICULARLY FOR A FLEXIBLE TUBE

CROSS REFERENCE TO RELATED APPLICATIONS

This application claims priority under 35 U.S.C. § 119(a) to French Patent Application Serial Number 1653453, filed Apr. 19, 2016, French Patent Application Serial Number 1655899, filed Jun. 23, 2016, and French Patent Application Serial Number 1751860, filed Mar. 7, 2017, the entire teachings of which are incorporated herein by reference.

BACKGROUND OF THE INVENTION

Field of the Invention

The present invention relates to the field of flexible tubes including a closure liner sealing the neck prior to the first use of the tube, and to a perforating cap adapted to perforate the closure liner.

Description of the Related Art

Tubes are known that are provided with a closure liner associated with a perforating cap including a punch adapted to perforate the closure liner.

Indeed, the closure liner allows the product contained inside the tube to be hermetically preserved while it is stored prior to its first use, which represents a significant part of the overall lifetime of the tube.

Caps exist in which the punch is disposed inside the cap and projects therefrom in order to be able to perforate the closure liner when the cap is screwed onto the tube head. In order to ensure that the closure liner is preserved prior to the first use, a ring is disposed between the cap and the shoulder of the tube head in order to hold the punch at a distance from the closure liner when the cap is screwed onto the neck.

In order to perforate and/or cut the closure liner, the user firstly has to unscrew the cap, then remove the ring and finally screw the cap back on until the closure liner is perforated and/or cut. The number of steps is inconvenient for the user, who often does not understand the purpose of the ring and also does not necessarily understand that a closure liner has to be perforated before the first use of the tube.

Therefore, there is a requirement for a tube closure assembly that at least partly overcomes the aforementioned disadvantages.

BRIEF SUMMARY OF THE INVENTION

To this end, the present disclosure describes a tube closure assembly that includes:

- a tube head including a neck and a closure liner sealing the neck;
- a cap including a punch adapted to cut the closure liner, The neck and the cap are configured to allow the cap to be fixedly held on the neck in a first position—a standby position—in which the punch is held at a distance from the closure liner, and in a second position—a position of use—in which the punch perforates the closure liner.

Such an assembly allows the cap to be held in a standby position without having to use an additional part other than the neck and the cap. In other words, the free end of the punch projecting from the cap is held away from the closure liner sealing the neck and the closure liner is thus simply and reliably safeguarded against any perforation or cutting prior to the first use of the tube by a user, without complicating the closure assembly. In particular, such an assembly dispenses with the use of the spacer ring that is generally used in such a system to hold the punch away from the closure liner.

A cap is understood to be an object that allows leak-tight sealing of a receptacle, particularly an opening for discharging a product, in a reversible manner. A cap according to the invention thus can transition from an open position to a closed position and vice versa, mainly through a screwing or equivalent movement. The present invention does not include closure assemblies, such as a hinged service capsule, that are definitively fixed onto an opening and comprise a through hole for discharging the product and a tilting cover for sealing the hole.

According to various embodiments of the invention, which can be taken separately or in combination:

- the tube head further includes a shoulder;
- the neck and the shoulder are designed as a single-piece;
- the neck and the shoulder are integrally formed;
- the neck includes an upper end located in the vicinity of a discharge hole and a lower end opposite the upper end;
- the closure liner is located at the lower end of the neck;
- the tube head includes an insert;
- the closure liner defines a central zone of the insert;
- the insert at least partly covers a lower face of the shoulder;
- the neck and the cap are further configured to allow the cap to be held in a third position, called closed position, in which the neck and the cap provide a seal for the tube;
- the cap is configured to transition from the standby position to the position of use by at least one rotational movement;
- the cap is configured to transition from the position of use to the closed position by at least one rotational movement;
- the cap and the neck define a longitudinal axis Z-Z;
- the cap is further configured to transition from the standby position to the position of use by an axial movement along the axis Z-Z;
- the cap is further configured to transition from the position of use to the closed position by an axial movement along the axis Z-Z;
- the rotational movement and the axial movement are simultaneous and optionally correspond to a helical movement, particularly screwing, which can have a variable pitch;
- the axial movement and the rotational movement are successive and optionally correspond to a bayonet type movement;
- the assembly includes at least one first blocking means and/or one second blocking means;
- the one or more first blocking means and the one or more second blocking means cooperate in order to hold the cap in the standby position;
- the neck includes the at least one first blocking means;
- the first blocking means cooperate with the cap in order to hold the cap in the standby position;
- the cap includes the at least one second blocking means;
- the cap is held in the standby position by catching the cap on the neck, preferably by catching the one or more first and second blocking means;
- the one or more first blocking means are a ring located on an outer surface of the neck;
- the ring is axially located in a middle part of the neck;

the neck includes a thread, called first thread, allowing the rotational movement and/or the axial movement in order to transition the cap from the standby position and/or an intermediate position to the position of use and/or from the position of use to the closed position;

the first thread is located in a part of the neck above the ring;

the outer surface of the neck includes a smooth zone, called first smooth zone;

the ring is located between the first thread and the first smooth zone;

the one or more second blocking means are protuberances located on an inner surface of the cap;

the protuberances are evenly distributed on the periphery of the cap;

the protuberances are distributed on two rows so that the ring is located between the protuberances, in the standby position of the cap;

the protuberances are angularly offset between the two rows;

the protuberances are located on the lower part of the cap;

the assembly includes a first and/or a second thread;

the second thread cooperates with the first thread to allow the cap to transition from the standby position and/or from the intermediate position to the position of use;

the first and second threads do not yet cooperate and screwing the cap onto the neck is still pending when the cap is in the standby position;

the second thread cooperates with the first thread to allow the rotational movement and/or the axial movement in order to transition the cap from the standby position to the position of use and/or from the position of use to the closed position;

the second thread cooperates with the first thread in order to depart from the standby position;

the cap includes the second thread;

the second thread is located in a part of the cap above the protuberances;

the first thread is located facing a smooth zone of the inner surface of the cap, called second smooth zone, in the standby position of the cap;

the second smooth zone is located between the protuberances and the second thread;

an outer surface of the cap includes a smooth part and a ribbed part;

the protuberances are distributed so that the ring goes beyond the upper row of protuberances under the action of a pressure along the longitudinal axis Z-Z in order to reach an intermediate position;

the thread of the cap begins to engage in the thread of the neck in the intermediate position;

the whole of the thread of the neck is facing a smooth zone of the inner surface of the cap in the standby position;

the protuberances are distributed on two rows that are axially separated so as to allow the cap to freely rotate in the standby position;

the one or more first blocking means are one or more projecting elements;

the assembly includes at least one guide groove;

the one or more projecting elements are located at an inlet of the groove;

the neck includes the at least one guide groove configured to cooperate with the cap to allow the rotational movement and/or the axial movement in order to transition the cap from the standby position to the position of use and/or from the position of use to the closed position;

the one or more projecting elements of the neck comprise protuberances from one or more edges of the guide groove;

the one or more projecting elements of the neck comprise protuberances coming from the base of the guide groove;

the groove extends on the outer surface of the neck, from the upper end to the lower end of the neck;

the groove has successive guide portions;

at least one first portion of the groove provides the standby position;

the first portion of the groove is substantially vertical relative to the axis Z-Z;

one or more other portions of the groove allow the transition from the standby position to the position of use and/or from the position of use to the closed position;

a second portion of the groove allows the cap to depart from the standby position;

a third portion of the groove allows the cap to transition to the position of use;

a final portion of the groove allows the cap to transition to the closed position;

the second portion succeeds the first portion;

the second portion is substantially horizontal relative to the axis Z-Z;

the third portion is substantially vertical relative to the axis Z-Z;

the second portion is helical with a pitch x;

the third portion is helical with a pitch y;

the pitch y of the third helical portion is greater than the pitch x of the second helical portion;

the final portion is horizontal relative to the axis Z-Z;

the groove includes an inlet located towards the discharge hole of the neck;

the projecting elements of the neck are located at the inlet of the groove;

at least one of the projecting elements of the neck is located between the first portion and the second portion of the groove;

the cap includes at least one projecting element configured to cooperate with the projecting elements of the neck in order to hold the cap in the standby position;

the one or more projecting elements of the cap are configured to cooperate with the groove of the neck to allow the rotational movement and/or the axial movement in order to transition the cap from the standby position to the position of use and/or from the position of use to the closed position;

the one or more projecting elements of the cap are located on the lower part of the cap;

the neck includes a guide ramp configured to cooperate with at least one projecting element of the cap in order to position the projecting element at the inlet of the groove;

the guide ramp has a guide direction opposite the guide direction of the groove in order to transition the cap from the standby position to the position of use and/or from the position of use to the closed position;

the cap includes an upper surface;

the upper surface has at least one opening in alignment with the projecting elements of the cap;

the number of openings is identical to the number of projecting elements of the cap;

the cap includes a sealing ring located radially set back from the openings of the cap in order to provide the seal for the closure;

the sealing ring is configured to cooperate with a sealing ring seat provided on an inner surface of the neck when the cap is in the closed position, particularly in the vicinity of the upper end of the neck.

The invention further relates to a tube including an assembly as previously described.

Additional aspects of the invention will be set forth in part in the description which follows, and in part will be obvious from the description, or may be learned by practice of the invention. The aspects of the invention will be realized and attained by means of the elements and combinations particularly pointed out in the appended claims. It is to be understood that both the foregoing general description and the following detailed description are exemplary and explanatory only and are not restrictive of the invention, as claimed.

BRIEF DESCRIPTION OF THE SEVERAL VIEWS OF THE DRAWINGS

The accompanying drawings, which are incorporated in and constitute part of this specification, illustrate embodiments of the invention and together with the description, serve to explain the principles of the invention. The embodiments illustrated herein are presently preferred, it being understood, however, that the invention is not limited to the precise arrangements and instrumentalities shown, wherein.

DETAILED DESCRIPTION OF THE INVENTION

Figure 1:
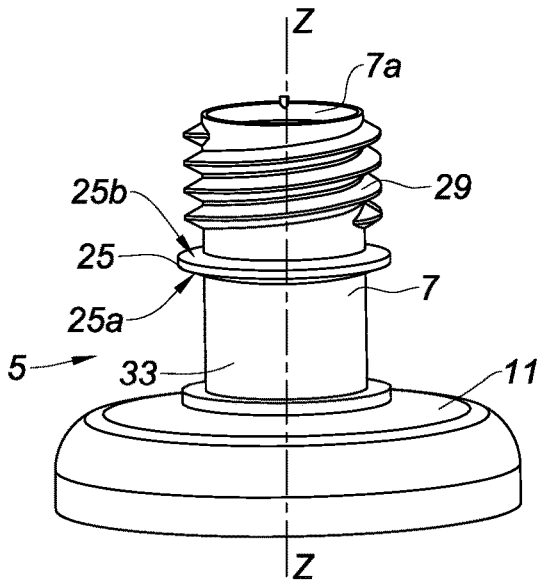
FIG. 1 is a perspective view of a tube, which is partially shown, including a tube head for a tube closure assembly according to a first embodiment of the invention.

As shown in the various Fig., the invention relates to an assembly 1 for closing a tube 3. The assembly 1 includes:

a tube head 5 including a neck 7; and a cap 9 configured to be fixed onto the neck 7, particularly by screwing.

The tube head 5, a variant of which is shown in FIGS. 1 and 3 to 8, includes the neck 7 defining a longitudinal axis Z-Z, a shoulder 11 and a full insert 13 forming a closure liner 15 sealing the neck 7, in the lower part thereof. As shown herein, the neck 7 and the shoulder 11 are designed as a single-piece and are integrally formed. The insert 13 is located against a lower face of the shoulder 11 that is intended to be oriented towards the inside of the tube.

The neck 7 in this case is in the form of a cylinder extending from an upper end, which is located towards the outside of the tube 3, towards a lower end, which is opposite the upper end and is directed towards the inside of the tube 3. The upper end has a discharge hole 7*a* allowing the product that is contained inside the tube to be discharged. The lower end is adjacent to the shoulder 11.

The shoulder 11 extends from the lower end of the neck towards an outer periphery, which in this case is cylindrical, in a direction that is substantially perpendicular to the axis Z-Z, i.e. the part of the tube head flaring out from the neck 7. The shoulder 11 is configured so that a tube skirt can be fixed, particularly on its periphery, in order to form the tube 3.

More specifically, the insert 13 includes a peripheral section, typically of truncated or disc shape, and a central section forming the closure liner 15, the diameter of which typically corresponds to the inner diameter of the neck 7.

Figure 2:
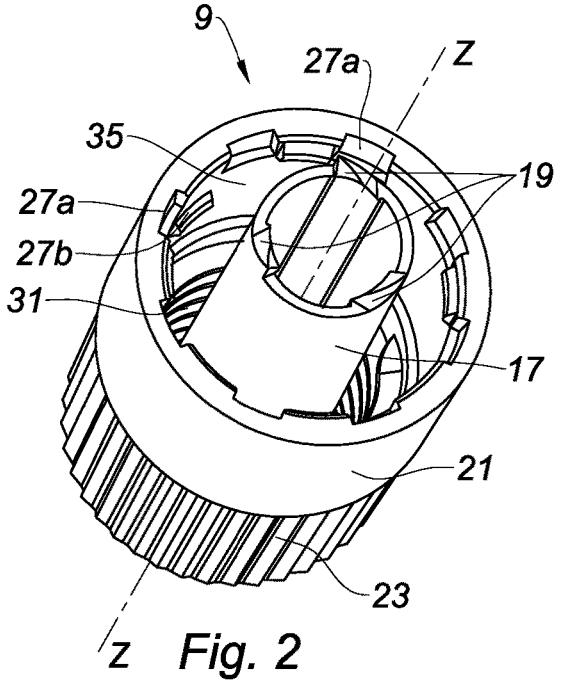
FIG. 2 is a perspective view of a cap intended to be fixed onto the tube head of FIG. 1.

In general, the cap 9, an example of which is shown in FIG. 2, includes a punch 17 projecting from the cap 9. The punch 17 is particularly integral with the cap 9. The punch 17 is configured so as to be inserted inside the neck 7 of the tube head 5 when the cap 9 is fixed onto the neck 7. A longitudinal direction of the cap 9 is defined, which corresponds to the longitudinal axis Z-Z of the neck 7 when the cap 9 is fixed onto the neck 7.

The punch 17 allows the closure liner 15 to be cut and/or perforated. Advantageously, the cut is partial, so that the one or more portions of the closure liner 15 that have been cut remain connected to the rest of the insert, thus preventing any of the material forming the insert from being mixed with a product contained in the associated tube 3 and the possible distribution of this material to the user.

In general, the punch 17 has a cylindrical section of revolution, a free end of which is advantageously provided with cutting means so that when the cap 9 is fixed, for example screwed, onto the neck 7 of the tube head 5, the free end of the punch 17 is inserted inside the neck 7. The cutting means can be a bevelled shape of the free end, teeth and/or cutting slits, for example, evenly distributed on the periphery of the free end of the punch 17. The example of a punch 17 shown in FIGS. 2 and 4 to 8 is a punch 17 with a cylindrical section of revolution, the free end of which is provided with three short teeth 19 that are evenly distributed on the periphery of its free end.

Figure 15A:
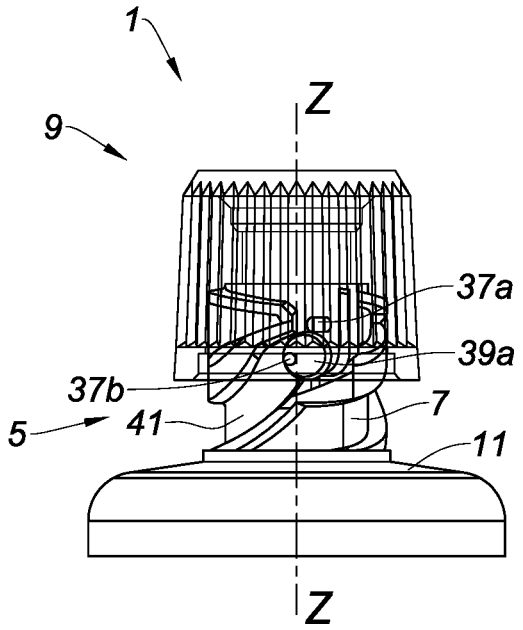
FIGS. 15*a* and 15*b* are as FIGS. 14*a* and 14*b*, the closure assembly departing from the standby position and priming the position of use.
Figure 15B:
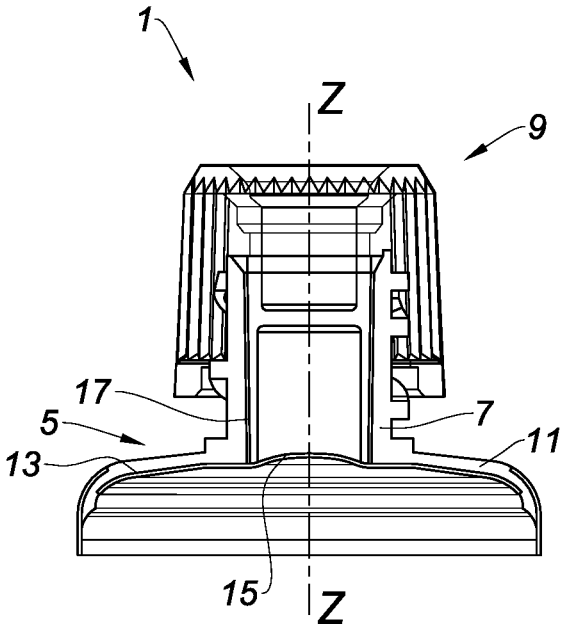

According to the present invention, the neck 7 and the cap 9 are configured to allow the cap 9 to be fixedly held on the neck 7 in a first position, called standby position (FIGS. 3 to 5 and 14*a*, 14*b*), in which the punch 17 is held at a distance from the closure liner 15, and in a second position, called position of use (FIGS. 8 and 15*a*, 15*b*), in which the punch 17 perforates the closure liner 15.

Figure 16A:
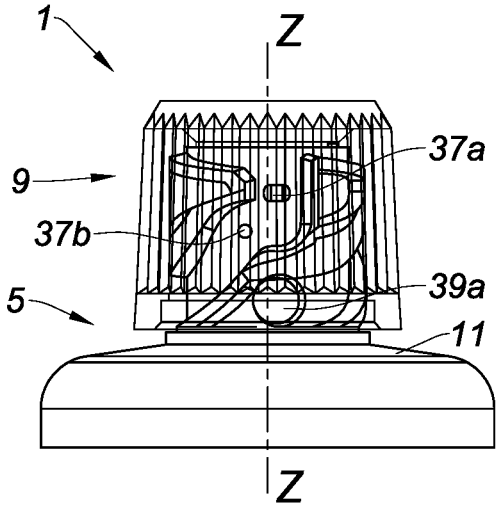
FIGS. 16*a* and 16*b* are as FIGS. 14*a* and 14*b*, the closure assembly being in a closed position.

The neck 7 and the cap 9 also can be configured to allow the cap 9 to be held in a third position, called closed position (FIGS. 7 and 16*a*, 16*b*), in which the neck 7 and the cap 9 provide a seal for the tube 3.

Advantageously, the cap 9 is configured to transition from the standby position to the position of use and/or from the position of use to the closed position by at least one rotational movement.

In certain embodiments, the rotational movement also can be simultaneously accompanied by an axial movement along the axis Z-Z. This then involves a helical movement.

In other embodiments, the axial movement is carried out after the rotational movement.

Advantageously, the cap 9 is configured to transition from the standby position to the position of use and/or from the position of use to the closed position, basically by a movement that always proceeds in the same direction, in other words the direction of rotation is always the same.

Advantageously, the transition of the cap 9 from the standby position to the position of use and/or from the position of use to the closed position is reversible. It is thus possible to open and then close the tube after use, and vice versa.

Advantageously, the neck 7 includes at least one first blocking means configured to cooperate with the cap 9 in order to hold the cap 9 in the standby position.

In a first embodiment, the neck 7 and the cap 9 each comprise at least one blocking means cooperating together to hold the cap 9 in the standby position.

In the example of this first embodiment shown herein in FIGS. 1 to 7, the one or more first blocking means are a ring 25 located on an outer surface of the neck 7 and the one or more second blocking means are protuberances 27*a*, 27*b* located on an inner surface of the cap 9.

In this example, the cap 9 is thus held in the standby position by catching the cap 9 on the neck 7, particularly by catching the ring 25 with the protuberances 27*a*, 27*b*.

Advantageously, the protuberances 27*a*, 27*b* are evenly distributed on the periphery of the cap 9, particularly on the lower part of the cap 9. In the example shown herein, the protuberances 27*a*, 27*b* are distributed on two rows, which are axially separated, and are angularly offset between the two rows so that the ring 25 is located between the protuberances 27*a*, 27*b* in the standby position of the cap 9. Preferably, each row includes at least two protuberances 27*a*, 27*b*, or at least three or at least four. In this case, each row includes four protuberances 27*a*, 27*b*.

The lower row of protuberances 27*a* allows the cap 9 to be fixedly held on the neck 7 and avoids unwanted removal of the cap 9. The upper row of protuberances 27*b* allows the downwards movement of the cap 9 to be limited when it is fixed onto the neck 7 and thus allows the punch 17 to be held away from the closure liner 15 and the perforation and/or the cutting thereof to be avoided without the intervention of the user, before the first use.

Advantageously, the ring 25 is integral with the neck 7 and covers the entire circumference of the neck 7. The ring 25 includes a lower surface 25*a* directed towards the shoulder 11 of the tube head 5 and an upper surface 25*b* directed towards the discharge hole 7*a* of the neck 7. The lower 25*a* and upper 25*b* surfaces are substantially flat and their radial extension allows the ring 25 to be caught between the protuberances 27*a*, 27*b*. The ring 25 particularly includes a thin end to help it to be caught between the protuberances 27*a*, 27*b* and to be disengaged therefrom in order for the user to easily transition from the standby position to the position of use, then from the position of use to the removal of the cap 9. Similarly, the protuberances 27*a*, 27*b* also can have a thin end, as can be seen herein. More specifically, herein the ring 25 has a straight trapezoid or triangular shaped section with a rounded apex and/or the protuberances 27*a*, 27*b* have a straight rounded section.

Advantageously, the neck 7 and the cap 9 each comprise a thread, called first thread 29 and second thread 31, cooperating together to allow the cap 9 to transition from the standby position to the position of use through the user screwing the cap 9 onto the neck 7. In this embodiment, the previously described rotational movement and axial movement are simultaneous and induce the screwing motion, according to a helical movement. The cap 9 is then fixed by screwing onto the neck 7, while in the standby position the threads 29 and 31 preferably are not engaged.

The first thread 29 is located on the outer surface of the neck 7 in a part thereof above the ring 25.

The second thread 31 is located on the inner surface of the cap 9 in a part thereof above the protuberances 27*a*, 27*b*, in this case at the bottom of the cap 9.

The neck 7 further includes a smooth zone, called first smooth zone 33, on its outer surface. A smooth zone is herein understood to be a non-threaded zone. The first smooth zone 33 extends on a part below the first thread 29 and below the ring 25. In other words, the first smooth zone 33 extends from the lower surface 25*a* of the ring 25 towards the shoulder 11 of the tube head 5. The ring 25 is thus axially located in a middle part of the neck 7, between the first thread 29 and the first smooth zone 33.

The cap 9 further includes a smooth zone, called second smooth zone 35, on its inner surface. Again, a smooth zone is understood to be a non-threaded zone. The second smooth zone 35 is located on a part below the second thread 31 and above the protuberances 27*a*, 27*b*, i.e. between the protuberances 27*a*, 27*b* and the second thread 31. In the example shown, the second smooth zone 35 extends from the bottom of the second thread 31 to the upper row of protuberances 27*b*. The inner diameter of the cap 9 at the second smooth zone 35 is greater than the diameter of the neck 7 measured at the crest of the threads of the first thread 29.

The cap 9 further includes an outer surface, a lower part of which is smooth 21 and the other upper part of which is ribbed 23. The ribbed part 23 particularly corresponds to a user gripping zone and facilitates the handling of the cap 9 and the opening/closing of the tube 3.

Figure 3:
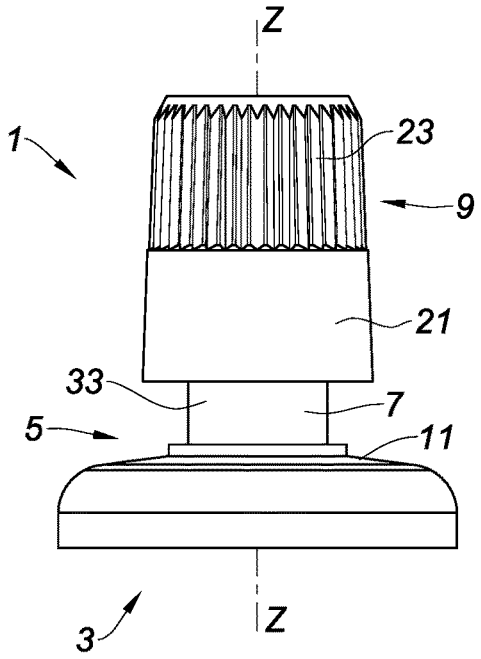
FIG. 3 is an elevation view of the tube of FIG. 1, onto which the cap of FIG. 2 is fixed in the standby position, the tube head and the cap forming a tube closure assembly according to the invention.
Figure 4:
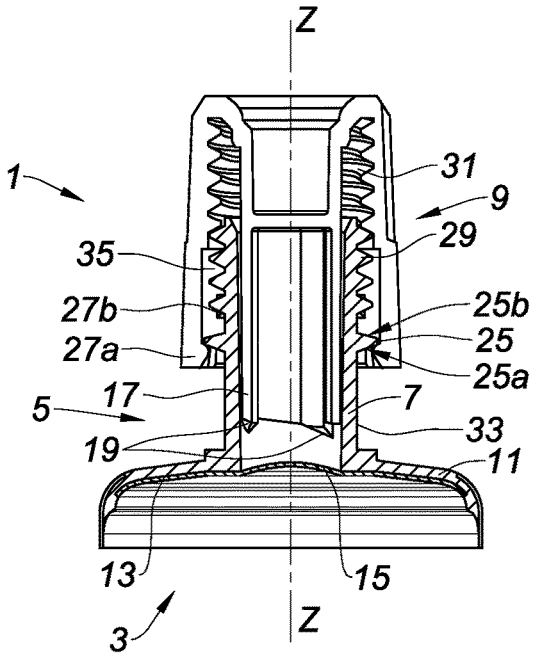
FIG. 4 is an axial section view of FIG. 3, the assembly being in the standby position, in a first configuration.
Figure 5:
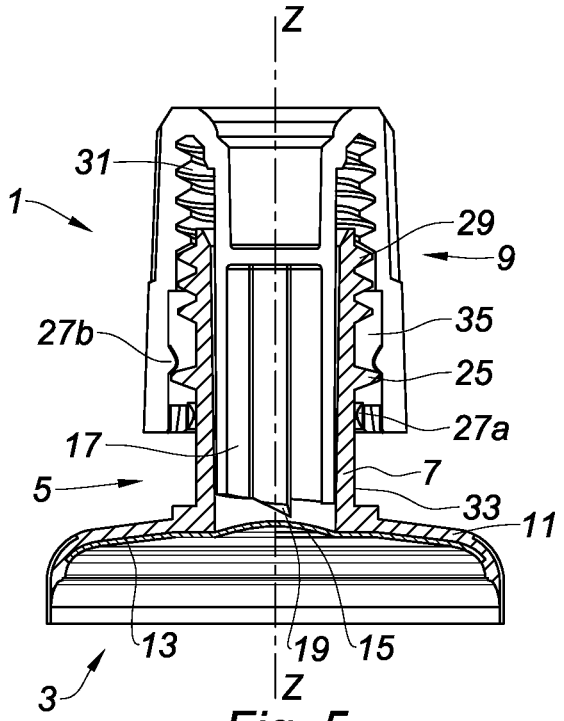
FIG. 5 is as FIG. 4, the closure assembly being in the standby position, in a second configuration.

Initially, the cap 9 is fixed onto the neck 7. In this step, the ring 25 is caught on the lower row of protuberances 27*a* and the cap 9 is held in the standby position (FIGS. 3 to 5). The punch 17 is located at a non-zero distance from the closure liner 15 to prevent it from being cut and/or perforated. In this case, this holding in the standby position is provided by the upper row of protuberances 27*b*, as previously described, on which the ring 25 comes into abutment in the event of an unintended attempt to press the cap 9 (FIG. 5). The position of the upper row of protuberances 27*b* is computed so that the punch 17 is held far enough away from the closure liner 15 in the standby position of the cap 9. The lower row of protuberances 27*a*, on which the ring 25 comes into abutment in the event of an unintended attempt to remove the cap 9 (FIG. 4), allows unwanted removal of the cap 9 to be avoided.

In this standby position, the first thread 29 is located facing the second smooth zone 35 of the cap 9, as can be seen in FIGS. 3 to 5. The first and second threads (29, 31) do not yet cooperate and screwing the cap 9 onto the neck 7 is still pending.

Figure 6:
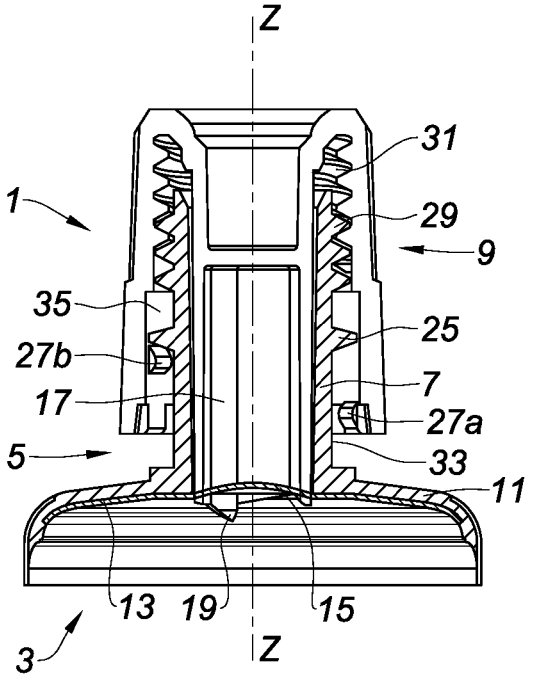
FIG. 6 is as FIG. 4, the closure assembly being in an intermediate position.
Figure 7:
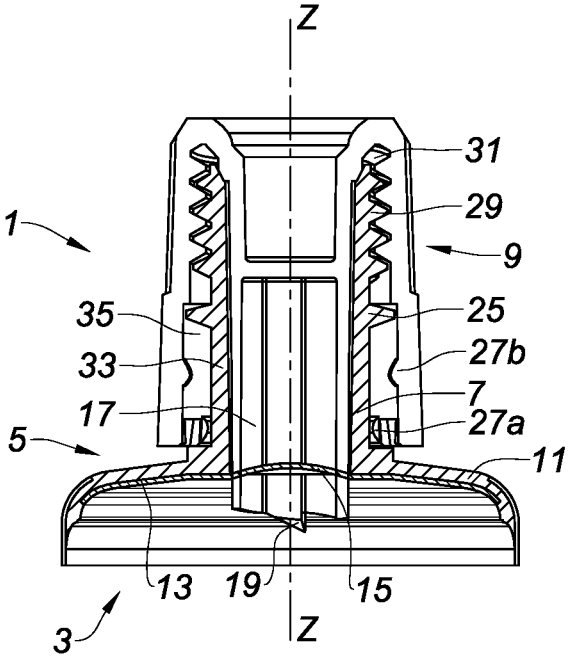
FIG. 7 is as FIG. 4, the closure assembly being in a position of use.

Secondly, the cap 9 is pressed onto the neck 7 by the user along the axis Z-Z so that the ring 25 goes beyond the upper row of protuberances 27*b* in order to reach an intermediate position (FIG. 6). In this intermediate position, the thread 31 of the cap 9 starts to engage in the thread 29 of the neck 7 and the punch 17 reaches, then perforates and/or cuts, the closure liner 15 on the one or more final screw turn(s).

It is also possible to contemplate, in a further embodiment that is not shown, that the threads 29 and 31 are in contact, or even engaged, from the standby position. Screwing then allows the transition from the standby position to the position of use to be facilitated, and particularly the surmounting of the upper row of protuberances 27*b* by the ring, in order to reach the intermediate position.

Finally, the cap 9 is fully screwed onto the neck 7 by the user. The cap 9 thus reaches the closed position (FIG. 7), in which the closure liner 15 is cut and/or perforated by the punch 17. The smooth zone 35 of the cap 9 is then facing the smooth zone 33 of the neck 7.

Further embodiments can be contemplated that allow the cap to be fixed onto the neck and to be held in the standby position. In particular, it is possible for the ring and the protuberances to be reversed, i.e. for the cap to comprise a ring on its inner surface cooperating with at least one protuberance located on the outer surface of the neck.

In the embodiments shown in FIGS. 8 to 17, the one or more blocking means are one or more projecting elements 37*a*, 37*b*, 37*c* located on an outer surface of the neck 7.

The projecting elements 37*a*, 37*b*, 37*c* of the neck 7 are configured to cooperate with the cap 9 in order to hold the cap 9 in the standby position and, more specifically, to cooperate with at least one projecting element 39 of the cap 9.

Advantageously, the neck 7 further includes at least one guide groove 41, in this case three, configured to cooperate with the cap 9 to allow the rotational movement and/or the axial movement in order to transition the cap 9 from the standby position to the position of use and/or from the position of use to the closed position.

More specifically, the guide groove 41 of the neck 7 is configured to cooperate with the one or with each projecting element 39 of the cap 9, particularly to allow the rotational movement and/or the axial movement in order to transition the cap 9 from the standby position to the position of use and/or from the position of use to the closed position.

Thus, the groove 41 extends on the outer surface of the neck 7, from the upper end of the neck 7 located in the vicinity of the discharge hole 7*a* to the lower end opposite the upper end. The groove 41 particularly includes an inlet 41*a* located towards the discharge hole 7*a* of the neck 7.

Advantageously, the groove 41 has successive guide portions. This can particularly involve a first portion 41*b* determining the standby position and other portions allowing the transition from the standby position to the position of use and/or from the position of use to the closed position.

In particular, the groove 41 has:

- a second portion 41*c* allowing the cap 9 to depart from the standby position;
- a third portion 41*d* allowing the cap 9 to transition to the position of use;
- a final portion 41*e* allowing the cap 9 to transition to the closed position.

The groove 41 extends between two edges 55 that radially extend from a base 57 of the groove 41. Preferably, the groove 41 is integral with the neck 7.

Figure 8:
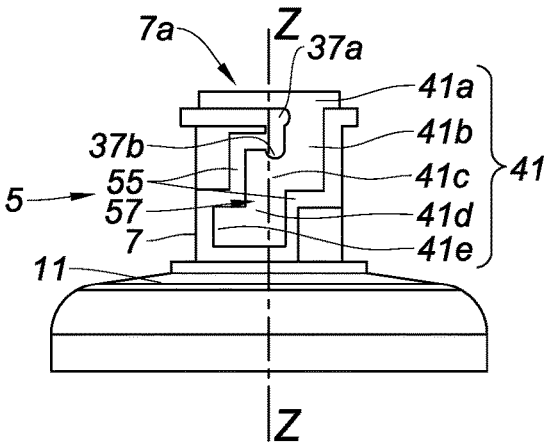
FIG. 8 is an elevation view of a tube, which is partially shown, including a tube head for a tube closure assembly according to a second embodiment of the invention.

In the embodiment shown in FIG. 8, the first portion 41*b* of the groove 41 is vertical relative to the axis Z-Z. It is followed by the second portion 41*c*, which is horizontal relative to the axis Z-Z, then by the third portion 41*d*, which is vertical relative to the axis Z-Z, and finally by the final portion 41*e*, which is horizontal relative to the axis Z-Z.

In this embodiment, the projecting elements 37*a*, 37*b* of the neck 7 are protuberances from the edges of the groove 41 extending towards the inside of the groove. Alternately, the projecting elements 37*a*, 37*b* of the neck 7 can be protuberances coming from the base 57 of the groove 41. Thus, the groove 41 has a first protuberance 37*a* located at the inlet of the first portion 41*b* of the groove 41. This first protuberance 37*a* limits the upwards axial movement of the cap 9 along the axis Z-Z and allows the cap 9 to be fixedly held on the neck 7 and unwanted removal thereof to be avoided.

The groove 41 also has a second protuberance 37*b*, of the same type, located between the first 41*b* and the second 41*c* portions of the groove 41. This second protuberance 37*b* limits the rotational movement of the cap 9 and particularly the departure of the cap 9 from its standby position and its engagement towards the position of use. In other words, this second protuberance 37*b* allows the punch 17 to be held away from the closure liner 15 and the perforation and/or the cutting thereof to be avoided without the intervention of the user, before the first use.

Figure 9:
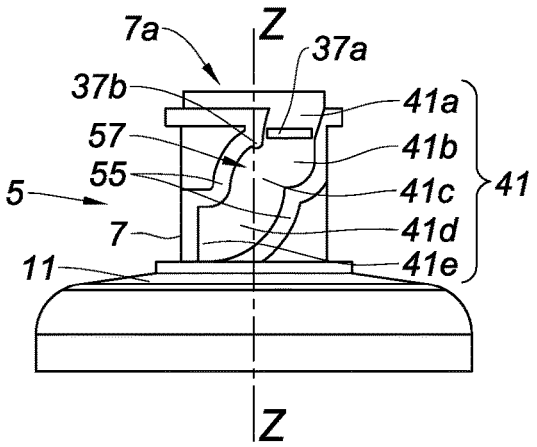
FIG. 9 is an elevation view of a tube, which is partially shown, including a tube head for a tube closure assembly according to a third embodiment of the invention.
Figure 11:
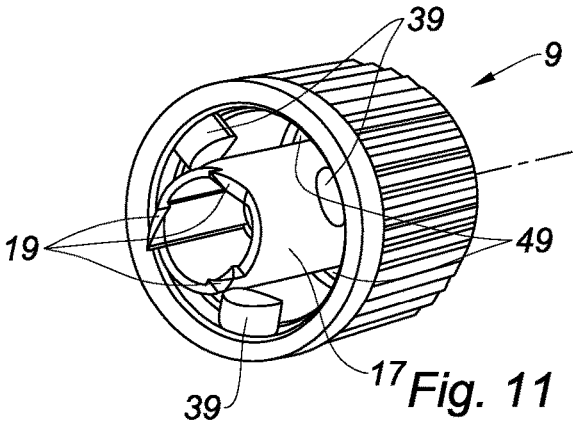
FIGS. 11 and 12 are perspective views of a cap intended to be fixed onto the tube head of FIGS. 8 to 10.
Figure 10:
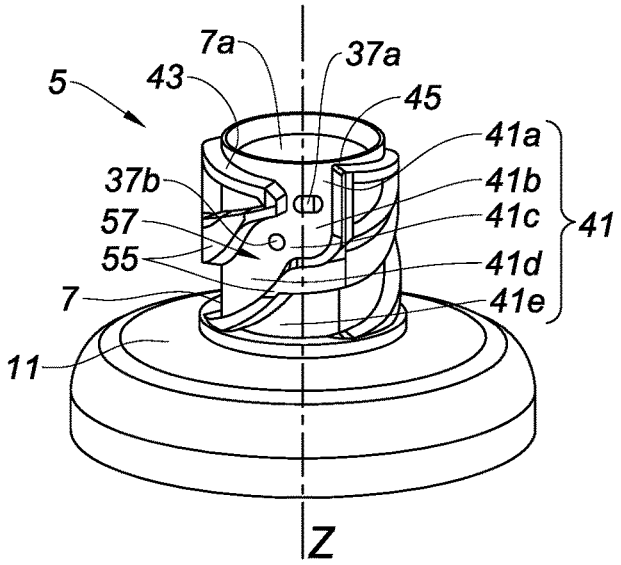
FIG. 10 is a perspective view of a tube, which is partially shown, including a tube head for a tube closure assembly according to a fourth embodiment of the invention.
Figure 12:
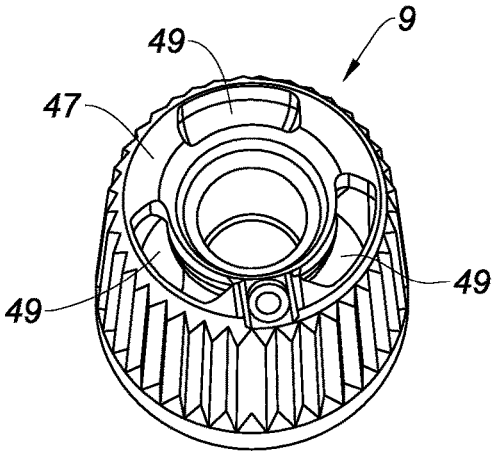
Figure 13:
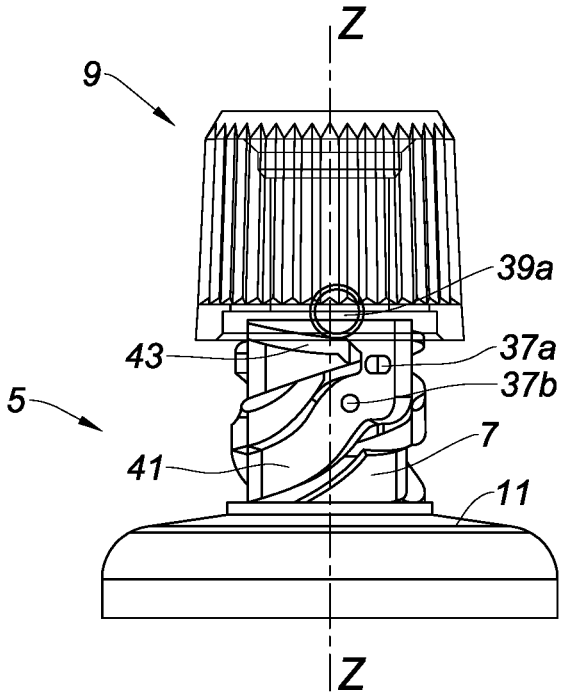
FIG. 13 is an elevation view of the tube of FIG. 10, on which the cap of FIGS. 11 and 12 is directed towards the standby position, the tube head and the cap forming a tube closure assembly according to the invention.
Figure 14A:
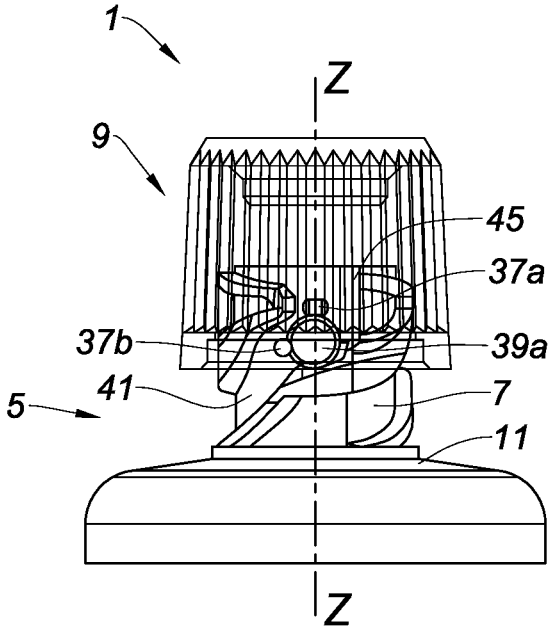
FIG. 14*a* is as FIG. 13, the closure assembly being in the standby position.
Figure 14B:
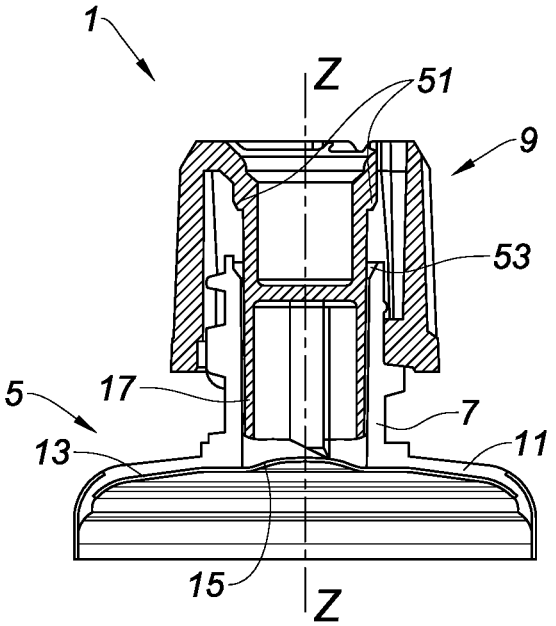
FIG. 14*b* is an axial section view of FIG. 14*a*, the assembly being in the standby position.

In the embodiment shown in FIG. 9, the first portion 41*b* of the groove 41 is vertical relative to the axis Z-Z. It is followed by the second portion 41*c*, which is horizontal relative to the axis Z-Z, then by the third portion 41*d*, which is helical, and finally by the final portion 41*e*, which is horizontal relative to the axis Z-Z.

In this embodiment, the neck 7 includes a first projecting element, which is a first catch 37*a* located at the inlet of the first portion 41*b* of the groove 41. This catch 37*a* limits the upwards axial movement of the cap 9 along the axis Z-Z and allows the cap 9 to be fixedly held on the neck 7 and unwanted removal of the cap 9 to be avoided. One of the edges of the groove 41 also has a protuberance 37*b*, which is a second projecting element of the neck 7. As is the case for the protuberances 37*a*, 37*b* of the embodiment of FIG. 8, this protuberance extends towards the inside of the groove 41. This protuberance 37*b* is located between the first 41*b* and the second 41*c* portion of the groove 41. It allows the rotational movement of the cap 9, and particularly the departure of the cap 9 from its standby position and its engagement in the position of use, to be limited. In other words, this protuberance 37*b* allows the punch 17 to be held away from the closure liner 15 and the perforation and/or the cutting thereof to be avoided without the intervention of the user, before the first use.

In the embodiment shown in FIGS. 10 to 16, the first portion 41*b* is vertical relative to the axis Z-Z. It is followed by the second portion 41*c*, which is helical with a pitch x, then by the third portion 41*d*, which is helical with a pitch y. The pitch y of the third helical portion 41*d* is greater than the pitch x of the second helical portion 41*c*. The groove 41 finally terminates at the final portion 41*e*, which is horizontal relative to the axis Z-Z.

In this embodiment, the neck 7 includes two projecting elements in the form of protuberances coming from the base of the guide groove. These two projecting elements are two catches 37*a*, 37*b* located towards the inlet 41*a* of the groove 41. More specifically, a first catch 37*a* is located at the inlet of the first portion of the groove 41. This catch 37*a* limits the upwards axial movement of the cap 9 along the axis Z-Z and allows the cap 9 to be fixedly held on the neck 7 and unwanted removal of the cap 9 to be avoided. The second catch 37*b* is located between the first 41*b* and the second 41*c* portions of the groove 41. It allows the rotational movement of the cap 9, and particularly the departure of the cap 9 from its standby position and its engagement towards the position of use, to be limited. In other words, this second catch 37*b* allows the punch 17 to be held away from the closure liner 15 and the perforation and/or the cutting thereof to be avoided without the intervention of the user, before the first use.

Figure 17:
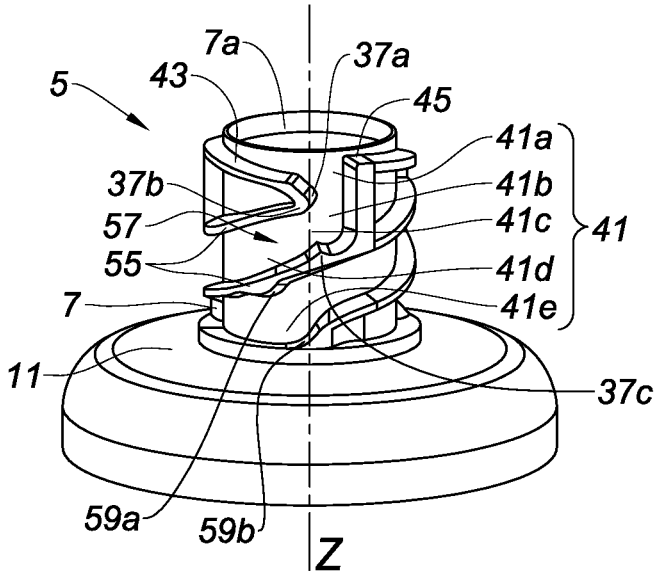
FIG. 17 is a perspective view of a tube, which is partially shown, including a tube head for a tube closure assembly according to a fifth embodiment of the invention.

In the embodiment shown in FIG. 17, the first portion 41*b* is vertical relative to the axis Z-Z. It is followed by the second portion 41*c*, which is helical with a pitch x, then by the third portion 41*d*, which is helical with a pitch y. The pitch y of the third helical portion 41*d* is greater than the pitch x of the second helical portion 41*c*. The groove 41 finally terminates at the final portion 41*e*, which is horizontal relative to the axis Z-Z.

In this embodiment, the projecting elements of the neck 7 are protuberances 37*a*, 37*b*, 37*c* from the edges of the groove 41 extending towards the inside of the groove. Thus, the groove 41 has a first protuberance 37*a* located at the inlet of the first portion 41*b* of the groove 41. This first protuberance 37*a* limits the upwards axial movement of the cap 9 along the axis Z-Z and allows the cap 9 to be fixedly held on the neck 7 and unwanted removal thereof to be avoided.

The groove 41 also has a second protuberance 37*b*, of the same type, located between the first 41*b* and the second 41*c* portions of the groove 41. This second protuberance 37*b* limits the rotational movement of the cap 9 and particularly the departure of the cap 9 from its standby position and its engagement towards the position of use. In other words, this second protuberance 37*b* allows the punch 17 to be held away from the closure liner 15 and the perforation and/or the cutting thereof to be avoided without the intervention of the user before the first use.

The groove 41 also has a third protuberance 37*c*, of the same type as the protuberances 37*a* and 37*b*, located on the edge opposite that which includes the protuberances 37*a* and 37*b*. As is the case for the protuberance 37*b*, this third protuberance 37*c* limits the rotational movement of the cap 9 and particularly the departure of the cap 9 from its standby position and its engagement towards the position of use.

In these four embodiments shown in FIGS. 8 to 17, the neck 7 can further comprise a guide ramp 43 configured to cooperate with at least one projecting element 39 of the cap 9 in order to position one of the projecting elements at the inlet 41*a* of the groove 41. The guide ramp 43 allows one of the projecting elements 39*a* of the cap 9 to be guided in the first portion 41*b* of the guide groove 41. The guide ramp 43 can be seen in FIG. 10.

Advantageously, the guide ramp 43 has a guide direction opposite the guide direction of the groove 41 for the transition of the cap 9 from the standby position to the position of use and/or from the position of use to the closed position. Thus, in order to position one of the projecting elements 39 of the cap 9 in the inlet of the groove 41, a rotational movement needs to be carried out in a direction opposite that which will be applied in the groove. This rotational movement is generally carried out by a machine in an automated manner. Once the cap 9 is in the standby position, a rotational movement needs to be made in a direction opposite that which is applied in the guide ramp, generally in the conventional direction of rotation for closing a cap 9, which is generally clockwise, in order for the cap 9 to depart from the standby position and prime the position of use and the cutting and/or perforation of the closure liner 15 by the punch 17. This two-way rotation prevents the machine from excessively rotating when placing the cap 9 in the standby position, from priming a transition to the position of use and the punch 17 from damaging the closure liner 15 before the tube is used.

Advantageously, the ramp 43 can further comprise a stop 45 for forcing one of the projecting elements 39 of the cap 9 to stop at the inlet 41*a* of the groove 41. In this case, the stop 45 is an extension of an edge of the first portion 41*b* of the groove 41 towards the hole 7*a* of the neck 7.

In these four embodiments shown in FIGS. 8 to 17, the cap 9 is identical. As previously described, it includes at least one projecting element 39 configured to cooperate with the projecting elements 37*a*, 37*b*, 37*c* of the neck 7 in order to hold the cap 9 in the standby position and to cooperate with the groove 41 of the neck 7 to allow the rotational movement and/or the axial movement in order to transition the cap 9 from the standby position to the position of use and/or from the position of use to the closed position.

Advantageously, the cap 9 includes at least two projecting elements 39. Preferably, the cap 9 includes three projecting elements 39, which allows the cap 9 to be balanced and stabilised when it is in the standby position.

Advantageously, the one or more projecting elements 39 of the cap 9 are located on the lower part of the cap 9 and are integral therewith.

Advantageously, an upper surface 47 of the cap 9 has at least one opening 49 in alignment with the projecting elements 39 of the cap 9. These openings 49 are particularly used to mould the cap 9 and, more specifically, to mould the projecting elements 39. Thus, the number of openings 49 is identical to the number of projecting elements 39 of the cap 9.

In the cap 9 shown herein, the projecting elements of the cap 9 are studs 39, the diameter of which is substantially similar to the width of the guide grooves 41 to allow the studs 39 to be guided thereby. In this case, the cap 9 includes three studs 39 evenly distributed on the lower part of the cap 9 and three openings 49 on its upper surface 47 in alignment with the studs 39.

Figure 16B:
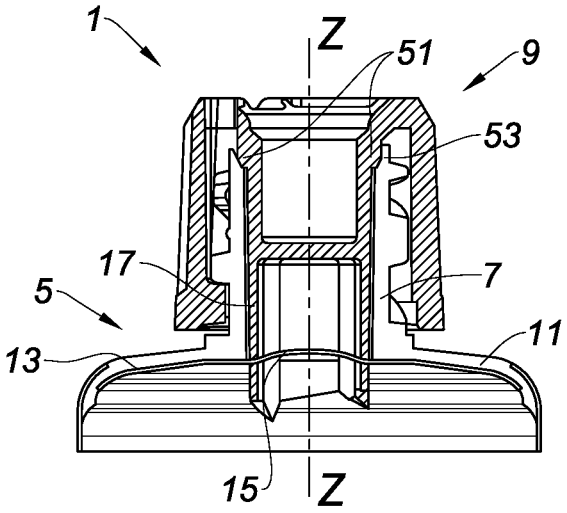

In order to seal the tube when the cap 9 is in the closed position, the cap 9 includes, on the inner face of its upper surface, an overthickness of material that corresponds to a sealing ring 51 located radially set back from the openings 49. The sealing ring 51 is configured to cooperate with a ring seat 53 provided on an inner surface of the neck, at the upper end of the neck 7, when the cap 9 is in the closed position, as can be seen in FIG. 16*b*.

The edges of the groove 41 can further comprise at least one protuberance located in the final portion 41*e* allowing the cap to be held in the closed position.

For example, as shown in FIG. 17, each edge can comprise a protuberance 59*a* and 59*b*. These protuberances 59*a*, 59*b* not only allow the cap to be held in the closed position, but also can be used to act as a closure indicator for the user. Thus, the resistance that is perceived by the user when the projecting elements 39 surmount the two protuberances 59*a* and 59*b* tells them that the cap has reached the end of its travel, that it is fully closed and that the seal is provided. These features are shown herein in connection with FIG. 17, but also can be generalised.

Various steps for placing the cap 9 in its standby position and for transitioning it from the standby position to the position of use and from its position of use to its closed position will now be described. These steps relate to the embodiment of the groove 41 shown in FIGS. 10 to 16.

Firstly, the cap 9 is fixed onto the neck 7 in its standby position. To this end, the projecting elements 39*a* of the cap 9 are guided in the guide ramp 43 by a rotational movement in the anticlockwise direction. This step can be seen in FIG. 13.

The projecting elements 39*a* of the cap 9 are then placed in the inlet 41*a* of the corresponding grooves 41 at their first portion 41*b*. They are held in rightwards abutment by the extension 45 of the first portion 41*b* of the groove 41 and in downwards abutment by the first catch 37*a* of the neck 7.

The cap 9 is then placed in its standby position by a downwards axial movement, in which each projecting element 39*a* engaged in the groove 41 is caught beyond the first catch 37*a*. The cap 9 is then held in the standby position by means of the first 37*a* and second 37*b* catches, which limit its leftwards (rotation) and upwards (translation) displacement, as previously described. This standby position can be seen in FIGS. 14*a* and 14*b*.

Through a first helical movement, each projecting element 39*a* of the cap 9 engaged in the groove 41 at the second portion 41*c* is caught beyond the second catch 37*b* and the cap 9 departs from the standby position. This step can be seen in FIGS. 15*a* and 15*b*.

Then, through a second helical movement generated by the third portion 41*d* of the groove 41, the projecting element 39*a* transitions to the position of use, in which the closure liner is perforated.

The helical movement finally ends when each projecting element 39*a* engaged in the groove 41 reaches a stop position located at the end of the final portion 41*e* of the groove 41. The cap 9 is then in the closed position, which can be seen in FIGS. 16*a* and 16*b*.

In order to remove the cap 9, the user completes the steps in the opposite direction.

In the other embodiments of the guide groove 41 shown in FIGS. 8, 9 and 17, the various steps for placing the cap 9 in its standby position and for transitioning it from the standby position to the position of use and from its position of use to its closed position are substantially similar.

Finally, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "includes" and/or "including," when used in this specification, specify the presence of stated features, elements, and/or components, but do not preclude the presence or addition of one or more other features, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

I claim:

1. An assembly for closing a tube, said assembly comprising:

a tube head comprising a neck and a closure liner sealing said neck;

a cap comprising a punch adapted to cut said closure liner, said neck and said cap being configured to allow said cap to be fixedly held on said neck in a first standby position in which the punch is held at a distance from the closure liner, and in a second position of use in which said punch perforates said closure liner, said neck comprising at least one guide groove configured to cooperate with said cap to allow a rotational movement and/or an axial movement in order to transition said cap from the standby position to the position of use and/or from the position of use to the closed position, said groove comprising successive guide portions including a first portion vertical relative to the axis determining the standby position, followed by a second portion which is helical with a pitch x and allowing the cap to depart from the standby position, then followed by a third portion which is helical with a pitch y and allowing the cap to transition to the position of use, then followed by a final portion which is horizontal relative to the axis and allowing the cap to transition to the closed position, the pitch of the third helical portion being greater than the pitch x of the second helical portion.

2. The assembly according to claim 1, wherein said neck and said cap are further configured to allow said cap to be held in a third closed position in which said neck and said cap provide a seal for said tube.

3. The assembly according to claim 1, wherein said cap is configured to transition from the standby position to the position of use and/or from the position of use to the closed position by at least one rotational movement.

4. The assembly according to claim 3, wherein said cap and said neck define a longitudinal axis Z-Z, and wherein said cap is further configured to transition from the standby position to the position of use and/or from the position of use to the closed position by an axial movement along the axis Z-Z.

5. The assembly according to claim 1, wherein the rotational movement and the axial movement are simultaneous.

6. The assembly according to claim 4, wherein the axial movement and the rotational movement are successive.

7. The assembly according to claim 4, wherein said neck comprises one or more first blocking means cooperating with said cap to hold said cap in the standby position.

8. The assembly according to claim 7, wherein said cap comprises one or more second blocking means, said one or more first blocking means and said one or more second blocking means cooperating to hold said cap in the standby position.

9. The assembly according to claim 7, wherein said one or more first blocking means are a ring located on an outer surface of said neck.

10. The assembly according to claim 9, wherein the ring is axially located in a middle part of said neck.

11. The assembly according to claim 9, wherein said neck comprises a first thread allowing at least one of said rotational movement and said axial movement in order to transition said cap from the standby position to the position of use and from the position of use to the closed position, said first thread being located in a part of said neck above the ring.

12. The assembly according to claim 11, wherein said one or more second blocking means are protuberances located on an inner surface of said cap.

13. The assembly according to claim 12, wherein said protuberances are evenly distributed on the periphery of said cap.

14. The assembly according to claim 12, wherein said protuberances are distributed on two rows so that the ring is located between said protuberances in the standby position of the cap.

15. The assembly according to claim 12, wherein said protuberances are angularly offset between the two rows.

16. The assembly according to claim 12, wherein the protuberances are located on the lower part of said cap.

17. The assembly according to claim 12, wherein said cap comprises a second thread cooperating with said first thread to allow said rotational movement and/or said axial movement in order to transition said cap from the standby position to the position of use and/or from the position of use to the closed position, said second thread being located in a part of said cap above said protuberances.

18. The assembly according to claim 17, wherein said first thread is located facing a smooth zone of the inner surface of said cap in the standby position of the cap.

19. The assembly according to claim 18, wherein said smooth zone is located between the protuberances and the second thread.

20. The assembly according to claim 7, wherein said one or more first blocking means are one or more projecting elements located on an outer surface of said neck.

21. The assembly according to claim 1, wherein said neck comprises an upper end located in the vicinity of a discharge hole and a lower end opposite said upper end, said groove extending on the outer surface of said neck, from the upper end to the lower end of the neck.

22. The assembly according to claim 1, wherein said groove has successive guide portions, at least one first portion of which provides the standby position and one or more other portions allow the transition from the standby position to the position of use and/or from the position of use to the closed position.

23. The assembly according to claim 1, wherein said groove comprises an inlet located towards said discharge hole of said neck, said projecting elements of said neck being located at the inlet of said groove.

24. The assembly according to claim 1, wherein said cap comprises at least one projecting element configured to cooperate with said projecting elements of said neck to hold said cap in the standby position.

25. The assembly according to claim 24, wherein said one or more projecting elements of said cap are configured to cooperate with said groove of said neck to allow said rotational movement and/or said axial movement in order to transition said cap from the standby position to the position of use and/or from the position of use to the closed position.

26. The assembly according to claim 24, wherein the one or more projecting elements of said cap are located on the lower part of said cap.

27. The assembly according to claim 26, wherein said neck comprises a guide ramp configured to cooperate with at least one projecting element of the cap in order to position one of the projecting elements at the inlet of the groove, said guide ramp having a guide direction opposite the guide direction of the groove for the transition of the cap from the standby position to the position of use and/or from the position of use to the closed position.

28. The assembly according to claim 27, wherein said guide ramp comprises a stop for forcing one of the projecting elements of the cap to stop at the inlet of the groove.

29. The assembly according to claim 26, wherein said guide ramp comprises at least one protuberance configured to allow the cap to be held in the closed position.

* * * * *